US011014136B2

(12) United States Patent
Xu et al.

(10) Patent No.: US 11,014,136 B2
(45) Date of Patent: May 25, 2021

(54) INTEGRATED MOLDING DEVICE SUITABLE FOR BENDING AND HEMMING OF FLAT SHEET

(71) Applicant: Nanjing University Of Posts And Telecommunications, Jiangsu (CN)

(72) Inventors: Fengyu Xu, Jiangsu (CN); Min Xiao, Jiangsu (CN); Fanchang Meng, Jiangsu (CN); Jingjin Shen, Jiangsu (CN); Yingjiang Zhou, Jiangsu (CN); Guoping Jiang, Jiangsu (CN)

(73) Assignee: Nanjing University Of Posts And Telecommunications, Jiangsu (CN)

( * ) Notice: Subject to any disclaimer, the term of this patent is extended or adjusted under 35 U.S.C. 154(b) by 0 days.

(21) Appl. No.: 16/768,076

(22) PCT Filed: Oct. 25, 2018

(86) PCT No.: PCT/CN2018/111819
§ 371 (c)(1),
(2) Date: May 29, 2020

(87) PCT Pub. No.: WO2020/034393
PCT Pub. Date: Feb. 20, 2020

(65) Prior Publication Data

US 2020/0360979 A1 Nov. 19, 2020

(30) Foreign Application Priority Data

Aug. 13, 2018 (CN) ..... 201810915549.1

(51) Int. Cl.
*B21D 5/06* (2006.01)
*B21D 37/10* (2006.01)
*B21D 19/08* (2006.01)

(52) U.S. Cl.
CPC ..... *B21D 5/06* (2013.01); *B21D 19/08* (2013.01); *B21D 37/10* (2013.01)

(58) Field of Classification Search
CPC . B21D 5/00; B21D 5/06; B21D 37/10; B21D 37/12; B21D 19/00; B21D 19/08;
(Continued)

(56) References Cited

U.S. PATENT DOCUMENTS 4,510,785 A * 4/1985 Triouleyre ..... B21D 43/105 72/323

FOREIGN PATENT DOCUMENTS

CN 201088992 7/2008
CN 202655488 1/2013
(Continued)

OTHER PUBLICATIONS

"International Search Report (Form PCT/ISA/210) of PCT/CN2018/111819", dated May 16, 2019, with English translation thereof, pp. 1-4.

*Primary Examiner* — Shelley M Self
*Assistant Examiner* — Smith Oberto Bapthelus
(74) *Attorney, Agent, or Firm* — JCIP Global Inc.

(57) ABSTRACT

An integrated molding device suitable for the bending and hemming of a flat sheet, comprising a stand, a worktable, a slider, and a turning beam. The stand comprises a frame structure composed of an upper cross beam, a lower cross beam, and columns on both sides, two ends of the slider are connected to the columns on both sides by means of a pair of sliding pairs A respectively, and the clutching of a bending die is achieved by means of the linear movement of the sliding pairs A; the worktable is fixed on the lower cross beam, and the clutching of a pressing die is achieved by means of the linear movement of the sliding pairs A; two ends of a swing frame are connected to the columns on both
(Continued)

sides by means of one connecting block respectively, the connecting block and the columns are connected therebetween by means of a pair of rotating pairs B, and the connecting block and the swing frame are connected therebetween by means of a pair of sliding pairs C. The present device may achieve the bending or pressing of a flat sheet according to differences in the amount of up and down movements of the slider; and on the basis of the pressing of the flat sheet, the hemming of the flat sheet may be achieved in cooperation with the swinging of a swing beam.

8 Claims, 6 Drawing Sheets

(58) Field of Classification Search
CPC ..... B21D 5/04; B21D 5/042; B21D 5/0209; B21D 5/0254
USPC ..... 72/312–315, 389.3, 381, 394; 29/243.57, 29/243.58
See application file for complete search history.

(56) References Cited

FOREIGN PATENT DOCUMENTS

| | | |
|---|---|---|
| CN | 207043076 | 2/2018 |
| JP | 2009202204 | 9/2009 |
| JP | 2011218443 | 11/2011 |
| WO | 2006026797 | 3/2006 |

* cited by examiner

INTEGRATED MOLDING DEVICE SUITABLE FOR BENDING AND HEMMING OF FLAT SHEET

CROSS-REFERENCE TO RELATED APPLICATION

This application is a 371 of international application of PCT application serial no. PCT/CN2018/111819, filed on Oct. 25, 2018, which claims the priority benefit of China application no. 201810915549.1, filed on Aug. 13, 2018. The entirety of each of the above mentioned patent applications is hereby incorporated by reference herein and made a part of this specification.

BACKGROUND

Technical Field

The present invention relates to an integrated molding device suitable for the bending and hemming of a flat sheet, which can perform both bending and hemming on a flat sheet.

Description of Related Art

At present, there are two main molding modes for flat sheets, i.e., bending and hemming. Although both processing modes can achieve the corner molding of sheets, they have respective advantages and disadvantages and different ranges of applicability due to different principles of action mechanisms. For some parts with complex structures, the cooperation of bending and hemming methods may be required. In this case, both a bending machine and a hemming machine are required. The simultaneous use of multiple sets of equipment causes high cost, large occupied area and low efficiency. If the bending and hemming can be simultaneously completed with one set of equipment, production costs are greatly reduced.

SUMMARY

Technical Problem

In order to overcome the shortcomings in the prior art, the present invention provides an integrated molding device suitable for the bending and hemming of a flat sheet, which can complete both bending and hemming and has a compact structure, small occupied area, powerful functions, high efficiency, and complex functions.

Technical Solution

In order to achieve the foregoing objective, the present invention adopts the following technical solution:

an integrated molding device suitable for the bending and hemming of a flat sheet, comprising a stand, a worktable, a slider, a turning beam, a bending die, a pressing die, and a hemming die, wherein the bending die comprises an upper bending die and a lower bending die, and the pressing die comprises an upper pressing die and a lower pressing die;

the stand comprises a frame structure composed of an upper cross beam, a lower cross beam, and columns on both sides, two ends of the slider are connected to the columns on both sides by means of a pair of sliding pairs A respectively, the upper bending die is fixed on the underside of the upper cross beam, the lower bending die is fixed on the upper side of the slider, the clutching of the bending die is achieved by means of the linear movement of the sliding pairs A, and the bending of the flat sheet is achieved by means of the clutching of the bending die;

the worktable is fixed on the lower cross beam, the upper pressing die is fixed on the underside of the slider, the lower pressing die is fixed on the upper side of the lower cross beam, the clutching of the pressing die is achieved by means of the linear movement of the sliding pairs A, and the pressing of the flat material is achieved by means of the clutching of the pressing die; and the turning beam is mounted on the columns on both sides, the hemming die is disposed on the turning beam, and the hemming of the flat sheet is achieved by means of the turning movement of the turning beam.

Preferably, the turning beam comprises a swing frame, two ends of the swing frame are connected to the columns on both sides by means of one connecting block respectively, the connecting block and the columns are connected therebetween by means of a pair of rotating pairs B, and the connecting block and the swing frame are connected therebetween by means of a pair of sliding pairs C. The rotation of the swing frame relative to the worktable is achieved by means of the rotation of the rotating pairs B, and the adjustment of a rotating radius of the swing frame is achieved by means of the linear movement of the sliding pairs C.

The device can perform both bending and hemming on flat sheets. In the process of bending, the flat sheet is disposed between the upper bending die and the lower bending die, and the upper bending die and the lower bending die are moved simultaneously (the upper bending die is designed to be movable in position), or the lower bending die is moved alone (the lower bending die is driven to move by means of the movement of the slider), so as to achieve the bending of the flat sheet. In the process of hemming, the flat sheet is first placed on the lower pressing die, the position of the flat sheet is adjusted according to the amount of bending, and then the slider is moved downward to drive the lower pressing die down, the flat sheet is pressed, and then the sliding pair C is adjusted according to the thickness of the flat sheet, the swing frame swings, and the hemming die contacts the flat sheet and forces it to bend, thereby achieving the hemming process.

In the present invention, the bending or pressing of the flat sheet is achieved according to differences in the amount of up and down movements of the slider, and on the basis of the pressing of the flat sheet, the hemming of the flat sheet may be achieved in cooperation with the swinging of the swing beam. Two operations can be completed with one set of equipment. For flat sheets that require composite processing, the demand for the processing equipment is reduced, the occupied area of the equipment is reduced, and the processing cost is greatly lowered.

Specifically, the sliding pair A comprises a sliding slot formed on the column and a bump disposed on the side of the slider, and the bump moves back and forth in the sliding slot to form the sliding pair A. The structure is a relatively simple and effective structure, which can satisfy the functional requirements while reducing the complexity of the equipment and lowering the cost of the equipment itself.

Specifically, the rotating pair B comprises a cylindrical groove formed on the column and a cylindrical boss disposed on the connecting block, and the cylindrical boss is mounted in the cylindrical groove and is rotated in the cylindrical groove to form the rotating pair B. The structure is a relatively simple and effective structure, which can satisfy the functional requirements while reducing the complexity of the equipment and lowering the cost of the equipment itself.

Specifically, the moving pair C comprises a guide slot formed on the connecting block and a guide block disposed on the swing frame, and the guide block moves back and forth in the guide slot to form the sliding pair C. The structure is a relatively simple and effective structure, which can satisfy the functional requirements while reducing the complexity of the equipment and lowering the cost of the equipment itself.

Specifically, the swing frame is a U-shaped frame structure, and the guide blocks are disposed on two side arms of the swing frame. The structure is a relatively simple and effective structure, which can satisfy the functional requirements while reducing the complexity of the equipment and lowering the cost of the equipment itself.

Specifically, during hemming, two ends of the component on which the hemming die is mounted preferably can keep clearance fit between the two sides and the inner sides of the columns on both sides fit at any position. This design enables the columns on both sides to have a certain limit effect on the turning beam when it is rotated, thereby improving the operation stability of the equipment, and prolonging the service life of the equipment.

Specifically, the upper bending die and the lower bending die of the bending die are a V-shaped upper die and a V-shaped lower die. Dies of other shapes can also be used according to the bending requirements of flat sheets.

Specifically, a wedge-shaped structure or an arc-shaped structure is provided on the worktable for avoiding the hemming die. This design can save materials and improve the operation safety and reliability of the equipment.

Specifically, the lengths of the slider, the upper bending die, the lower bending die, and the upper pressing die are shorter than the spacing between the columns on both sides. The bottom of the worktable is fixed on the lower cross beam, and two sides of the worktable are fixedly connected to the columns on both sides, and the length of the lower pressing die is longer than that of the upper pressing die.

Advantageous Effect

The integrated molding device suitable for the bending and hemming of a flat sheet provided in the present invention can achieve the bending or pressing of the flat sheet according to the amount of up and down movements of the slider. On the basis of the pressing of the flat sheet, the hemming of the flat sheet may be achieved in cooperation with the swinging of the swing beam. The design of the moving pair C allows the device to adapt to the hemming requirements of the flat sheets of different thicknesses. Two operations can be completed with one set of equipment. For flat sheets that require composite processing, the demand for the processing equipment is reduced, the occupied area of the equipment is reduced, and the processing cost is greatly lowered. Based on some detail designs, the cost of the equipment itself is can effectively lowered, and the stability and service life of the equipment are improved.

BRIEF DESCRIPTION OF THE DRAWINGS

FIG. 5(*b*) is a partial enlarged view of bending processing;

FIG. 6(*b*) is a partial enlarged view of hemming processing;

FIG. 7(*b*) is a schematic diagram of the position of the hemming die when the hemming process is finished.

DESCRIPTION OF THE EMBODIMENTS

The present invention is further described below with reference to the accompanying drawings.

Figure 1:
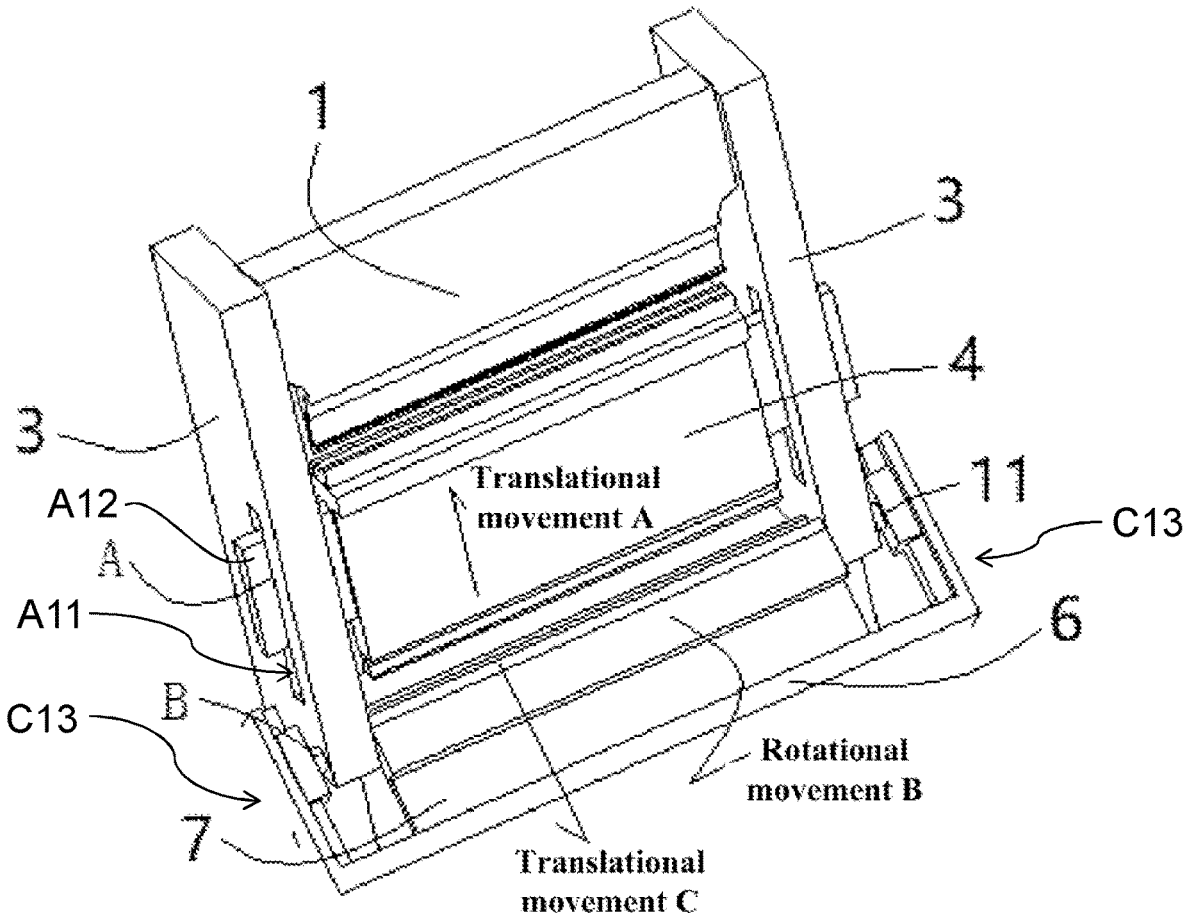
FIG. 1 is a schematic diagram of a stereoscopic structure of a device according to the present invention.
Figure 2:
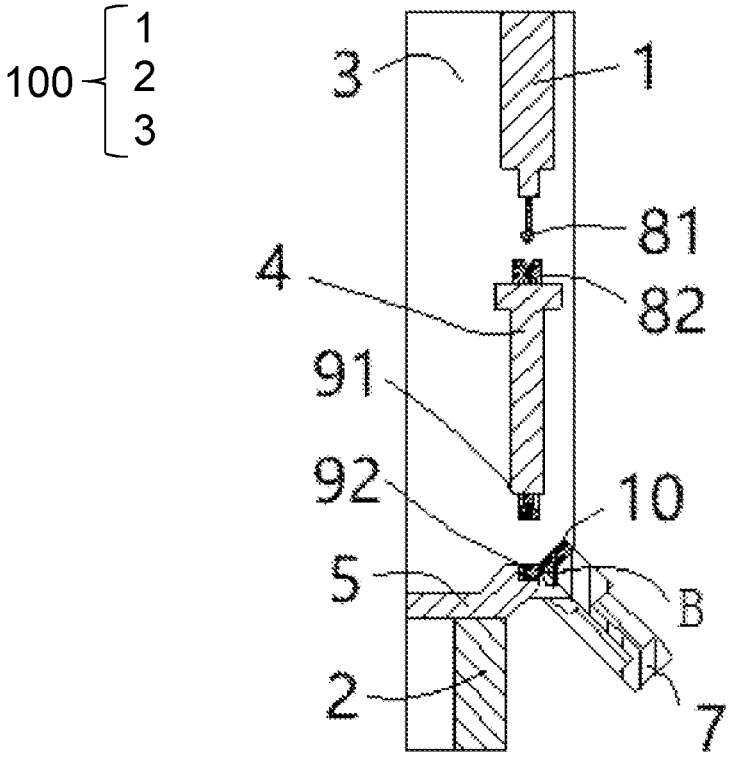
FIG. 2 is a schematic diagram of a cross-sectional structure of a device according to the present invention.
Figure 3:
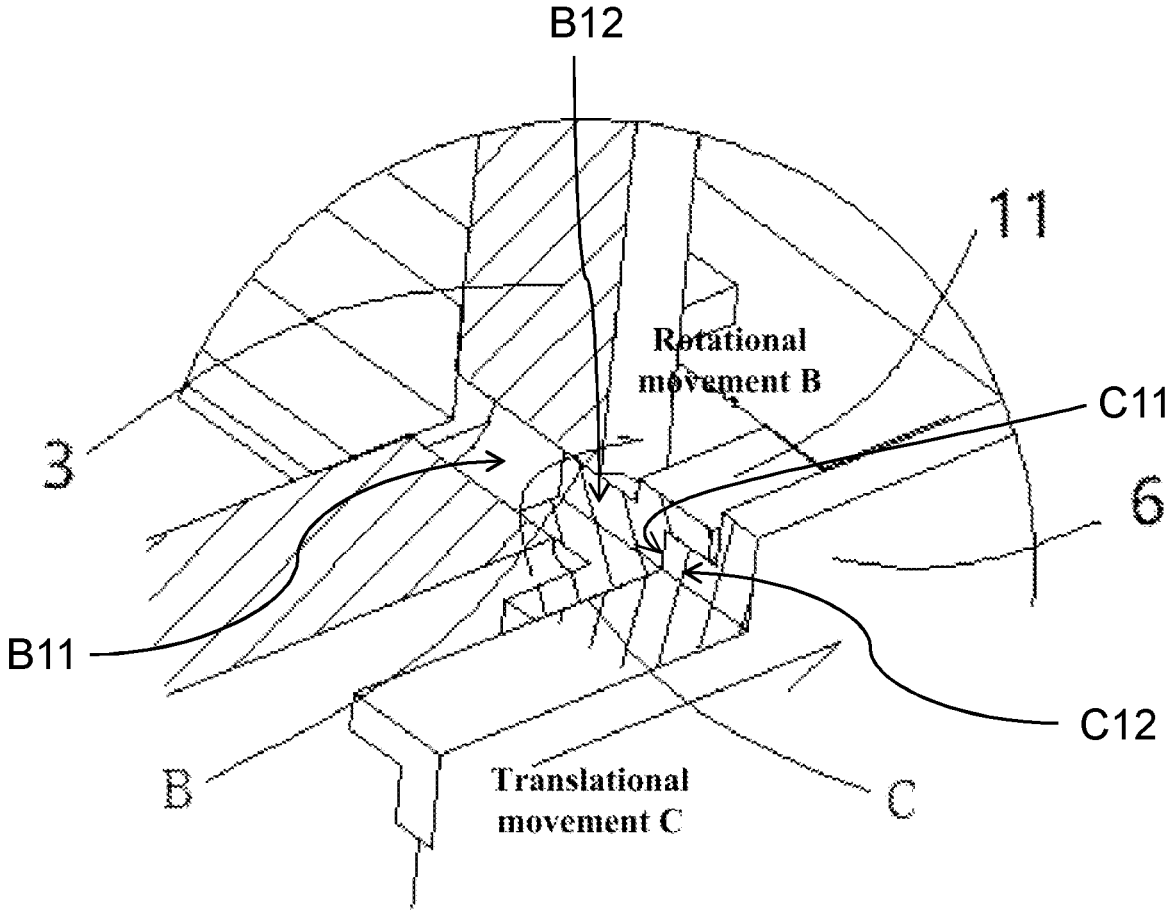
FIG. 3 is an enlarged schematic diagram of a partial structure of a connecting block area.

As shown in FIG. 1, an integrated molding device suitable for the bending and hemming of a flat sheet comprises a stand 100, a worktable, a slider, a turning beam, a bending die, a pressing die, and a hemming die, wherein the bending die comprises an upper bending die and a lower bending die, and the pressing die comprises an upper pressing die and a lower pressing die.

The stand 100 comprises a frame structure composed of an upper cross beam, a lower cross beam, and columns on both sides. Two ends of the slider are connected to the columns on both sides by means of a pair of sliding pairs A respectively. The upper bending die is fixed on the underside of the upper cross beam. The lower bending die is fixed on the upper side of the slider. The clutching of the bending die is achieved by means of the linear movement of the sliding pairs A. The bending of the flat sheet is achieved by means of the clutching of the bending die.

The worktable is fixed on the lower cross beam. The upper pressing die is fixed on the underside of the slider. The lower pressing die is fixed on the upper side of the lower cross beam. The clutching of the pressing die is achieved by means of the linear movement of the sliding pairs A. The pressing of the flat material is achieved by means of the clutching of the pressing die. The sliding pair A comprises a sliding slot A11 formed on the column and a bump A12 disposed on the side of the slider, and the bump A12 moves back and forth in the sliding slot A11 to form the sliding pair A.

The turning beam comprises a swing frame and a connecting block. Two ends of the swing frame are connected to the columns on both sides by means of one connecting block respectively. The connecting block and the columns are connected therebetween by means of a pair of rotating pairs B. The connecting block and the swing frame are connected therebetween by means of a pair of sliding pairs C. The swing frame and the connecting block together form a reversing beam. The rotation of the turning beam relative to the worktable is achieved by means of the rotation of the rotating pairs B. The adjustment of a rotating radius of the turning beam is achieved by means of the linear movement of the sliding pairs C. The rotating pair B comprises a cylindrical groove B11 formed on the column and a cylindrical boss B12 disposed on the connecting block, and the cylindrical boss B12 is mounted in the cylindrical groove B11 and is rotated in the cylindrical groove B11 to form the rotating pair B. The moving pair C comprises a guide slot C11 formed on the connecting block and a guide block C12 disposed on the swing frame, and the guide block C12 moves back and forth in the guide slot C11 to form the sliding pair C.

The hemming die is disposed on the side of the turning beam that is in contact with the flat sheet. The swing frame is a U-shaped frame structure, and the guide blocks C12 are disposed on two side arms of the swing frame C13.

The device can perform both bending and hemming on flat sheets. In the process of bending, the flat sheet is disposed between the upper bending die and the lower bending die, and the upper bending die and the lower bending die are moved simultaneously (the upper bending die is designed to be movable in position), or the lower bending die is moved alone (the lower bending die is driven to move by means of the movement of the slider), so as to achieve the bending of the flat sheet. In the process of hemming, the flat sheet is first placed on the lower pressing die, the position of the flat sheet is adjusted according to the amount of bending, and then the slider is moved downward to drive the lower pressing die down, the flat sheet is pressed, and then the sliding pair C is adjusted according to the thickness of the flat sheet, the swing frame swings, and the hemming die contacts the flat sheet and forces it to bend, thereby achieving the hemming process.

Figure 4A:
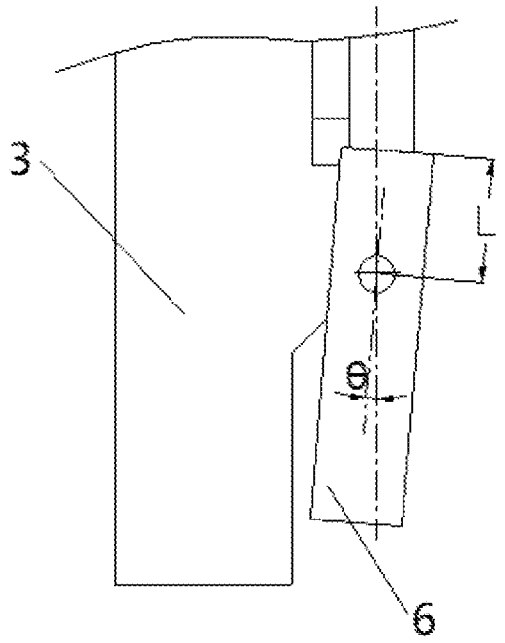
FIGS. 4(*a*) and 4(*b*) are schematic diagrams of two operation positions of a rotating pair B and a moving pair C.
Figure 4B:
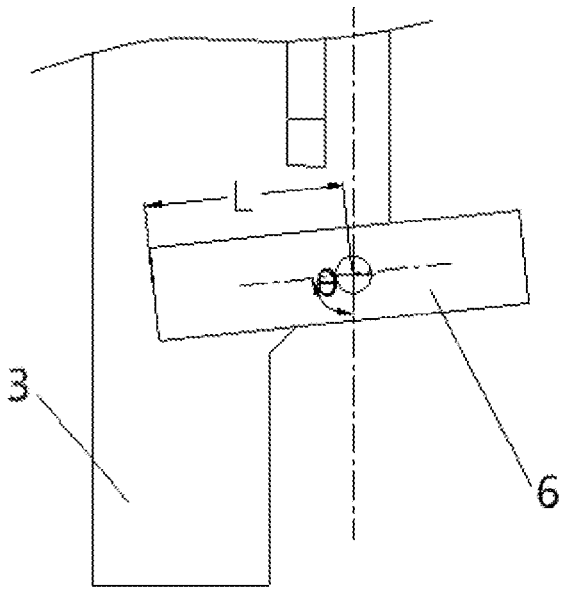
Figure 5A:
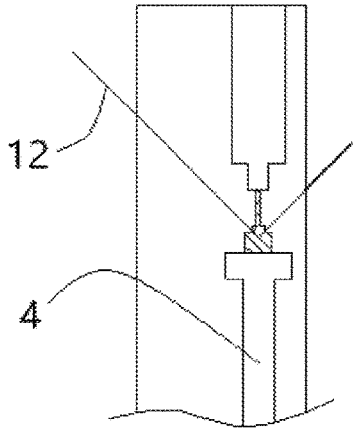
FIG. 5(*a*) is a schematic diagram of bending processing.
Figure 5B:
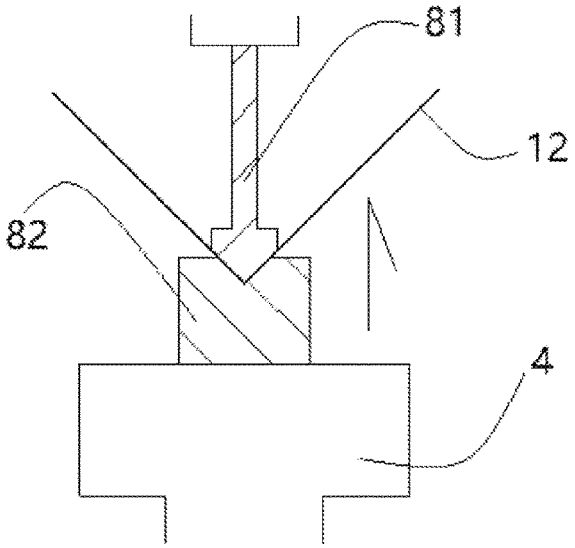
Figure 6A:
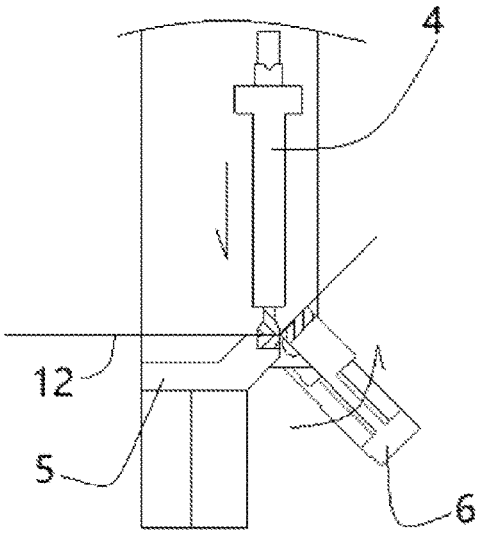
FIG. 6(*a*) is a schematic diagram of hemming processing.
Figure 6B:
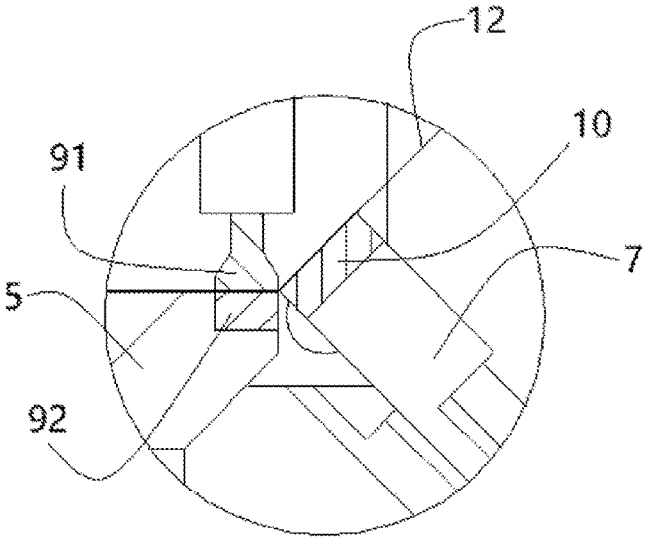
Figure 7A:
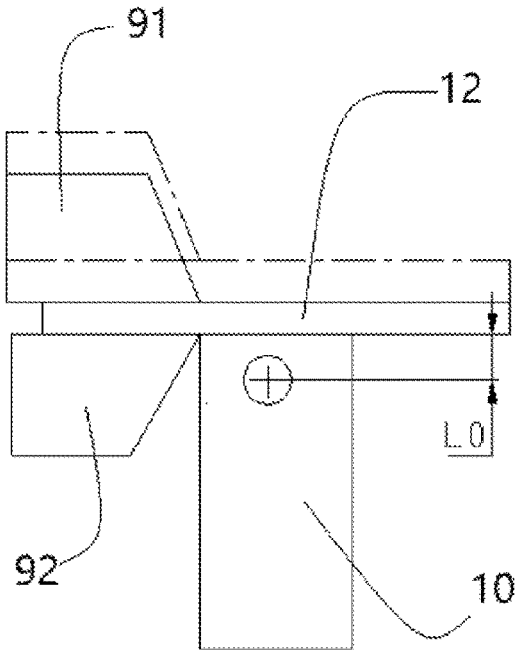
FIG. 7(*a*) is a schematic diagram of the position of a hemming die when the hemming process is started.
Figure 7B:
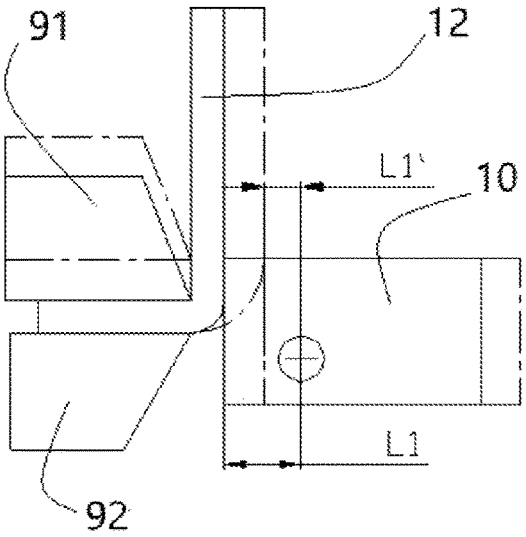

In the present invention, the positions of the rotating pair B and the moving pair C in the hemming process are as shown in FIGS. 4, 6, and 7. In the hemming process, the flat sheet is pressed against the lower pressing die by means of the upper pressing die, the turning beam is turned (the rotating pair B is rotated), and the turning beam is moved (the moving pair C is moved), so as to complete the hemming of the flat sheet.

The moving pair C is mainly used for different thickness of flat sheets. As shown in FIG. 7, the distance between a hinge point B and the flat sheet is L0 when the flat sheet is pressed against the lower pressing die by means of the upper pressing die and the turning beam is not moved, and L0 remains unchanged regardless of the thickness of the flat sheet. The distance between the hinge point B and the flat sheet is L1 after the hemming is completed. The flat sheets of different thicknesses cause different values of L1, for example, changing from L1 to L1'. This change is achieved by means of the moving pair C.

Figure 8:
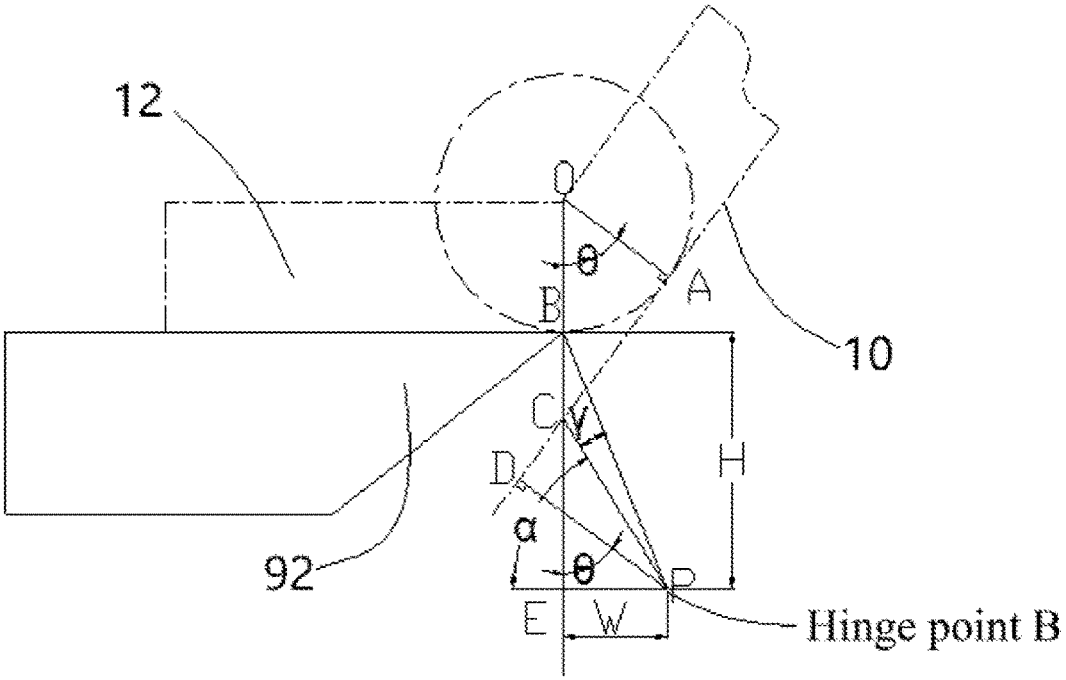
FIG. 8 is a calculation relationship diagram of a hemming angle and the amount of movement of the moving pair C.

As shown in FIG. 8, assuming that the thickness of the flat sheet is t, there are functional relationships between the turning angle (i.e., the hemming angle) θ of the turning beam and the amount of movement L of the moving pair C, specifically as follows:

$$OA = t;$$

$$BC = t\left(\frac{1}{\cos\theta} - 1\right);$$

$$CE = H - BC;$$

$$\alpha = \arctan\left(\frac{CE}{W}\right);$$

$$\gamma = \alpha + \theta - \frac{\pi}{2};$$

$$PC = \frac{W}{\cos\alpha}; \text{ and}$$

$$L = PD = PC \times \cos\gamma.$$

The contents above are only preferred embodiments of the present invention, and it should be noted that those of ordinary skill in the art can make several modifications and improvements, without departing from the principle of the present invention. These improvements and modifications should also be construed within the protection scope of the present invention.

What is claimed is:

1. An integrated molding device suitable for a bending and a hemming of a flat sheet, comprising a stand, a worktable, a slider, a turning beam, a bending die, a pressing die, and a hemming die, wherein the bending die comprises an upper bending die and a lower bending die, and the pressing die comprises an upper pressing die and a lower pressing die;

the stand comprises a frame structure composed of an upper cross beam, a lower cross beam, and two columns on both sides, two ends of the slider are connected to the columns on both sides by a pair of first sliding pairs respectively, the upper bending die is fixed on an underside of the upper cross beam, the lower bending die is fixed on an upper side of the slider, a clutching of the bending die is achieved by a linear movement of the first sliding pairs, and the bending of the flat sheet is achieved by the clutching of the bending die;

the worktable is fixed on the lower cross beam, the upper pressing die is fixed on an underside of the slider, the lower pressing die is fixed on an upper side of the lower cross beam, a clutching of the pressing die is achieved by the linear movement of the first sliding pairs, and a pressing of a flat material is achieved by the clutching of the pressing die;

the turning beam is mounted on the two columns on both sides, the hemming die is disposed on the turning beam, and the hemming of the flat sheet is achieved by a turning movement of the turning beam.

2. The integrated molding device suitable for the bending and the hemming of a flat sheet according to claim 1, wherein the turning beam comprises a swing frame, two ends of the swing frame are connected to the two columns on both sides by a connecting block respectively, the connecting block and the columns are connected therebetween by a pair of rotating pairs, and the connecting block and the swing frame are connected therebetween by a pair of second sliding pairs; the rotation of the swing frame relative to the worktable is achieved by the rotation of the rotating pairs, and the adjustment of a rotating radius of the swing frame is achieved by a linear movement of the second sliding pairs.

3. The integrated molding device suitable for the bending and the hemming of a flat sheet according to claim 2, wherein the rotating pair comprises a cylindrical groove formed on each of the columns and a cylindrical boss disposed on the connecting block, and the cylindrical boss is mounted in the cylindrical groove and is rotated in the cylindrical groove to form the rotating pair.

4. The integrated molding device suitable for the bending and the hemming of a flat sheet according to claim 2, wherein the second sliding pair comprises a guide slot formed on the connecting block and guide blocks disposed on the swing frame, and each of the guide blocks moves back and forth in the guide slot to form the second sliding pair.

5. The integrated molding device suitable for the bending and the hemming of a flat sheet according to claim 4, wherein the swing frame is a U-shaped frame structure, and the guide blocks are disposed on two side arms of the swing frame.

6. The integrated molding device suitable for the bending and the hemming of a flat sheet according to claim 1, wherein the first sliding pair comprises a sliding slot formed on each of the columns and a bump disposed on a side of the slider, and the bump moves back and forth in the sliding slot to form the first sliding pair.

7. The integrated molding device suitable for the bending and the hemming of a flat sheet according to claim 1, wherein the upper bending die and the lower bending die of the bending die are a V-shaped upper die and a V-shaped lower die.

8. The integrated molding device suitable for the bending and the hemming of a flat sheet according to claim 1, wherein lengths of the slider, the upper bending die, the lower bending die, and the upper pressing die are shorter than the spacing between the columns on both sides; a bottom of the worktable is fixed on the lower cross beam, and two sides of the worktable are fixedly connected to the columns on both sides, and a length of the lower pressing die is longer than that of the upper pressing die.

* * * * *